United States Patent [19]

Boothman

[11] 4,392,317

[45] Jul. 12, 1983

[54] SIGN LETTER CONSTRUCTION

[76] Inventor: Edwin F. Boothman, 117 Marion Dr., Sherwood Park, Alberta, Canada

[21] Appl. No.: 279,263

[22] Filed: Jul. 1, 1981

[30] Foreign Application Priority Data

Nov. 10, 1980 [CA] Canada ..... 364402

[51] Int. Cl.[3] ..... G09F 7/02

[52] U.S. Cl. ..... 40/618

[58] Field of Search ..... 40/596, 618, 584

[56] References Cited

U.S. PATENT DOCUMENTS

| | | | |
|---|---|---|---|
| 940,316 | 11/1909 | Holt | 40/596 |
| 3,358,398 | 12/1967 | Chaplin | 40/596 |
| 3,675,355 | 7/1972 | Shanok | 40/596 |
| 3,675,405 | 6/1966 | Bank | 40/596 |
| 4,140,405 | 2/1979 | Shapiro | 40/596 |

FOREIGN PATENT DOCUMENTS

| | | | |
|---|---|---|---|
| 770864 | 11/1967 | Canada | 40/596 |
| 2094524 | 4/1972 | France | 40/618 |

*Primary Examiner*—Robert A. Hafer
*Assistant Examiner*—Wenceslao J. Contreras
*Attorney, Agent, or Firm*—Bradford E. Kile

[57] ABSTRACT

A simplified method of constructing letters for signs and the letters produced by such method. The letters comprise first and second letter-form members of similar size and shape that are maintained in parallel spaced relation by a thin, pliable, plastic strip material which extends around their peripheries and is adhesively secured to such peripheries so as to form a frame therearound.

6 Claims, 5 Drawing Figures

SIGN LETTER CONSTRUCTION

This invention relates to a simplified method of constructing letters for signs and to the letters produced by such method. More particularly, it relates to a method for constructing letters in which a letter-form is cut from sheet material and a pliable plastic strip is contoured and affixed to the edges thereof. 'Letters' in the context of this patent refers not only to letters of alphabets, but also to numbers, hieroglyphics and similar symbols.

Canadian Patent No. 770,864, granted to William Bank on Nov. 7, 1967, relates to a sign letter structure having strip material contoured around a letter-form, which strip material either is plastic coated metal with a lip on one edge of similar composition or is plastic with a lip of plastic coated metal. A generally thick letter-form has such strip material tightly fitted around it and then bonded to it. As mentioned, the strip material of the patent is formed with an intregral lipped edge along the perimeter of the viewable face of the composite letter structure. This edged strip material requires precise cutting of its lipped edge at points of bending and is costly to manufacture. If such bending of the strip material is not handled by a person skilled in such matters, a great amount of strip material and time may be wasted. A further disadvantage is the large initial investment in metal shaping equipment which is required. Another disadvantage of the sign letter constructions of this patent is that the letter-forms require substantial thickness if the letters are to be stable, which substantial thickness may also prevent difficulties to cutting such letter-forms from sheet material. A further disadvantage of the patented sign letter construction is the fixed width of the strip material which results in a fixed sign letter width.

Sign letters of the instant invention may be formed rapidly and efficiently by those unskilled in such matters utilizing materials readily obtainable. According to the invention, the letter-forms are formed from a thin, pliable, strip of polyvinyl chloride (PVC) or other similar plastic, which strip has a lip along one of its edges and can suitably be obtained in the form of a roll. The plastic strip can be moulded in pre-determined widths and if a width different from those pre-determined is required, a lengthwise cut can be made in strip material of the next larger pre-determined width. The plastic strip is wrapped around pre-cut letter-forms, being creased transversely to conform to sharp contours on the perimeter of the letter-forms. No cutting of the lip on the edge of the strip is required at the points of bending, as the lip bulges slightly when the strip is bent. The letter-forms may be cut from sheets of thin, rigid sheet material, such as a plastic laminate, as sold under the trade marks ARBORITE and FORMICA, or acrylic, metal or wood. For each such letter-form, this invention will require the cutting of an identically-shaped section letter-form from a lightweight, rigid sheet material, such as rigid polystyrene foam, rigid polyurethane foam or plywood. Suitable foam materials are sold under the trademarks GATERFOAM and LETTER-BACK.

Each letter formed under this invention will have a letter-form and a corresponding second letter-form maintained in parallel, spaced relation with similar orientation, and will each have its perimeter adhesively connected to one of the edges of the plastic strip wrapped therearound. This letter construction avoids all of the disadvantages of letter construction under the Bank patent, which disadvantages were previously discussed. In particular, since the depth dimension of the lip on the edge of the strip is small, approximating the strip thickness, no cutting of the lip is required before the strip is fitted to the contour of a letter-form. Also, since each letter is formed from a letter-form and a second letter-form, thickness of a letter-form is not a requirement for stability of the letter, and thus the letter-form utilized in this invention may be of thinner dimension and thus more economically produced. The small amount of assembly equipment also results in more economic production. A further advantage of letters produced under this invention is that they may be produced with any desired width.

In one form, the invention is a sign letter structure, comprising, first and second letter-form members; a thin, pliable plastic strip material, forming a frame around the members and thereby maintaining them in parallel spaced relation; and, adhesive means for securing the first and second letter-form members to the strip material. One of the letter-form members is cut from a generally thin, rigid sheet material and the other letter-form member, which has the same general shape, is cut from a lightweight, rigid sheet material. The thin, pliable, plastic strip material is moulded with a lip on one edge. The first letter-form member is secured to the interior side of the strip material at a position abutting the lip on the one edge thereof and the second letter-form member is secured to the interior side of the strip material near the other edge thereof. The strip material may be extruded polyvinyl chloride and the lightweight, rigid sheet material may be polystyrene foam.

In another form, the invention is a method for constructing sign letters, comprising the steps of cutting a first letter-form member from a generally thin, rigid sheet material; cutting a second letter-form member, having the same general shape and size as the first letter-form member, from a lightweight, rigid sheet material; and, wrapping a thin, pliable, plastic strip around the periphery of the first letter-form member, such that a lip along one edge of the strip is adjacent to the outside face of the first letter-form member. In this form, the invention also comprises the steps of adhesively securing the plastic strip in such configuration to adjacent points on the adjacent periphery of the first letter-form member; placing adhesive onto the inside surface of the plastic strip, near the other edge; and, placing the second letter-form member against the plastic strip in such a manner that its periphery abuts the inside surface of the plastic strip, near the other edge; such that the previously applied adhesive secures the plastic strip in such configuration to adjacent points on the periphery of the second letter-form member. The strip material may be polyvinyl chloride and the lightweight, rigid sheet material may be polystyrene foam.

A more detailed description of the preferred embodiment of the invention will now be given. To assist in understanding of the preferred embodiment, the accompanying drawings form a part of the specification.

Figure 1:
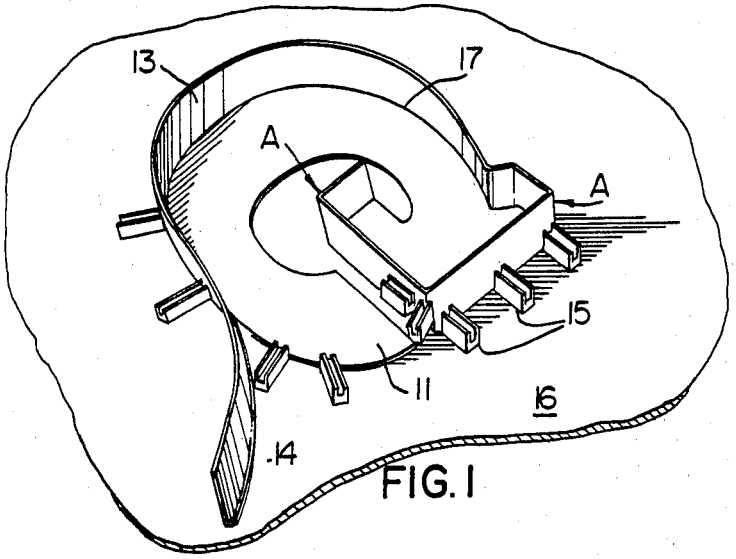
FIG. 1 is a perspective view of the initial stage of construction of a sign letter of the subject invention.
Figure 2:
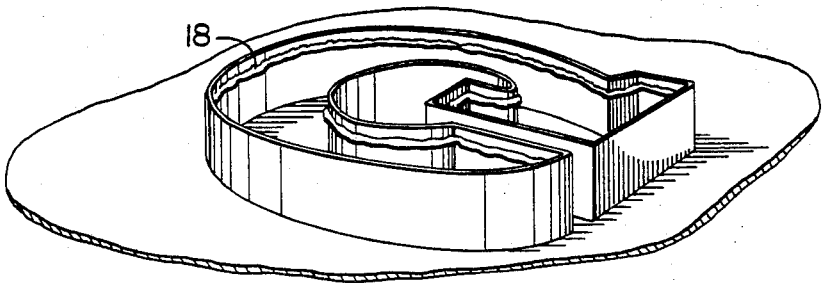
FIG. 2 is a perspective view of the intermediate stage of construction of a sign letter of the subject invention.
Figure 3:
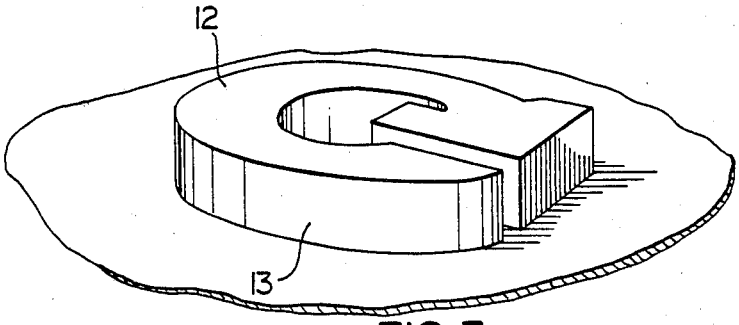
FIG. 3 is a perspective view of the final stage of construction of a sign letter of the subject invention.
Figure 4:
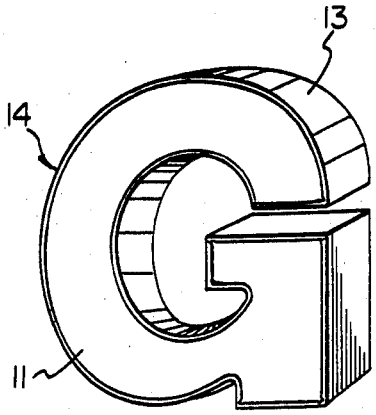
FIG. 4 is a perspective view of a completed sign letter of the subject invention.
Figure 5:
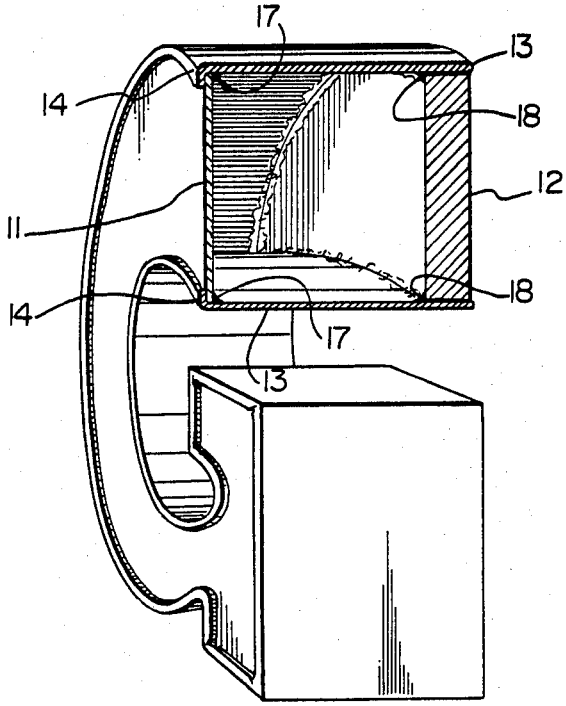
FIG. 5 is a partially-sectioned perspective view of a completed sign letter of the subject invention.

Referring now to a specific embodiment of this invention, as illustrated in the drawings, a first letter-form 11 is cut from a thin, rigid sheet material, such as a plastic laminate, as sold under the trade marks ARBORITE and FORMICA, or acrylic, metal or wood. The letter-form could also be constructed by molding a material such as acrylic. A second letter-form 12 of the same general shape and size is cut from a sheet of lightweight, rigid material, such as rigid polystyrene foam, rigid polyurethane foam or plywood. Suitable foam materials are sold under the trademarks GATERFOAM and LETTERBACK. Plywood can also be utilized. A polyvinyl chloride (PVC) strip 13, having a lip 14 along one edge, is wrapped around the periphery of the first letter-form in such a manner that the lip on the one edge of the strip abuts the outside surface of the first letter-form, as illustrated in FIG. 1. The depth dimension of the lip approximates the strip thickness and allows for bending of strip 13 without the necessity for cutting material therefrom, although a slight bulge does appear in the strip at each bend. The length of strip utilized in forming each letter will obviously depend upon the length of the periphery of the letter. A clamping arrangement, such as magnets 15 on a metal sheet 16 as illustrated in FIG. 1, is applied to maintain PVC strip 13 in abutment with the periphery of the first letter-form and a suitable adhesive 17 is then applied to the interior seam formed therebetween, as also illustrated in FIG. 1. Adhesive 17 could be any adhesive capable of forming a fast, strong bond between those materials. An adhesive marketed under the trademark KRAZY GLUE has been found to be suitable for this purpose. The same type of adhesive can be utilized to connect the ends of plastic strip 13 where they meet to form a transverse seam. After adhesive 17 has dried and the clamping arrangement has been removed, a suitable adhesive 18 is applied to the interior side of the other edge of strip 13, as illustrated in FIG. 2. As illustrated in FIG. 3, the second letter-form 12, constructed of lightweight, rigid sheet material, is then quickly placed against PVC strip 13 in such a manner that its periphery abuts the other edge of the strip and the outer face of the second letter-form 12 and the other edge of strip 13 are co-planar. Adhesive 18 then dries and permanently retains this abutting arrangement between PVC strip 13 and the second letter-form.

PVC strip having a lip on one edge is commercially available in pre-determined widths, ranging from approximately ½ inch to 5 inches. Intermediate widths can be formed by making a lengthwise cut in PVC strip of the next larger width, prior to assembly. Thus a sign letter of any desired thickness can be quickly constructed with commercially available PVC strip. Of course, the invention can be adapted to form sign letters of greater thickness.

At any sharp changes in contour around the periphery of the letter-forms, such as those illustrated as "A" in FIG. 1, PVC strip 13 is laterally creased. At such creases, the lip 14 bulges slightly but no material need be removed therefrom.

Once formed, the sign letter may be mounted on a wall or other display area by applying an adhesive to the outer surface of the second letter-form, which surface now forms the back of the sign letter, or may be mounted by other means.

The invention has been described in detail with particular reference to a preferred embodiment thereof, but it will be understood that variations and modifications can be effected within the spirit and scope of the invention.

I claim:

1. A sign letter structure, comprising:

a first letter-form member, cut from a generally thin, rigid sheet material, a second letter-form member, having an outer profile corresponding to that of the first letter-form member and cut from a lightweight, rigid sheet material, a thin, pliable plastic strip material, having a lip on one edge, such strip material being bent around the periphery of the letter-form members so as to conform to the outer profile of those members, the thickness and depth of the lip being such that it readily deforms at sharp bends in the strip material, and securing means for securing the first letter-form member to the interior side of the strip material at a position abutting the lip on the one edge thereof and the second letter-forming member to the interior side of the strip material near the other edge thereof, the members being maintained in parallel spaced relation.

2. The sign letter structure of claim 1, wherein the strip material is polyvinyl chloride.

3. The sign letter structure of claim 1 or 2, wherein the lightweight, rigid sheet material is polystyrene foam.

4. The sign letter structure of claim 1 or 2, wherein the lightweight, rigid sheet material is polyurethane foam.

5. The sign letter structure of claim 1 or 2, wherein the lightweight, rigid sheet material is plywood.

6. The sign letter structure of claim 1 or 2, wherein the securing means is adhesive.

* * * * *